United States Patent [19]

MacMillan et al.

[11] Patent Number: 4,747,363

[45] Date of Patent: May 31, 1988

[54] OARLOCK STABILIZER

[76] Inventors: William D. MacMillan, 15407 McGinty Rd. West, Minnetonka, Minn. 55345; Lyle W. Johnson, Jr., R.R. 4, Box 11, Willmar, Minn. 56201

[21] Appl. No.: 5,481

[22] Filed: Jan. 20, 1987

[51] Int. Cl.[4] ..... B63B 39/00; B63B 17/00

[52] U.S. Cl. ..... 114/361; 114/121; 114/364

[58] Field of Search ..... 114/121, 351, 361, 364, 114/294, 44, 122, 126, 230; 440/106, 108, 109, 101; 405/203

[56] References Cited

U.S. PATENT DOCUMENTS

| | | | |
|---|---|---|---|
| 331,460 | 12/1885 | Suckow | 114/44 X |
| 2,213,538 | 9/1940 | Whitehead | 440/101 X |
| 2,526,871 | 10/1950 | Johnson | 114/230 |
| 2,907,294 | 10/1959 | Lawler | 114/230 |
| 3,238,912 | 3/1966 | Perlick | 114/230 |
| 3,252,171 | 5/1966 | Kiriabou | 440/109 X |
| 3,740,780 | 6/1973 | Knipple | 114/364 |

FOREIGN PATENT DOCUMENTS

| | | | |
|---|---|---|---|
| 471271 | 2/1951 | Canada | 114/126 |

*Primary Examiner*—Sherman D. Basinger
*Attorney, Agent, or Firm*—Fitch, Even, Tabin & Flannery

[57] ABSTRACT

A boat stabilizing system for use with a boat having vertically-oriented tubular sockets adjacent the gunwales thereof. Vertically-oriented upright members in contact with the bottom extend upwardly through the water adjacent the tubular sockets. A clamping member is associated with each upright member and includes a tubular sleeve that slidingly overfits the upright member. Each tubular sleeve includes a screw clamp for securing the tubular sleeve to the upright. An arm secured to the tubular sleeve is sized to overlie the gunwale of the boat and includes a downwardly-extending pin member that is sized to be receivable in the tubular socket.

4 Claims, 1 Drawing Sheet

OARLOCK STABILIZER

The present invention relates to a system for stabilizing a boat and is more particularly concerned with a stabilizing device that interfits with the oarlock supports of the boat.

There are a number of activities involving relatively small, oar-powered boats where it is desired not only to anchor or fix the location of the boat, but also to provide a stable platform for performing the activity. For example, fishermen are able to cast their lines and hunters shoot their guns with greater accuracy and precision from a stable platform than from a rocking, shifting one. Further, rocking or shifting of the boat during such activities could lead to such potentially hazardous occurrences as falling overboard or capsizing.

Various devices have been proposed for stabilizing small boats, such devices being typified by those illustrated in U.S. Pat. Nos. 3,238,912, 2,907,294, and 2,526,871. Each of these patents discloses fixing the bottom of the boat to uprights or stilt members that are embedded in or in contact with the lake or river bed. While these devices serve to stabilize their associated boats, each is characterized by its relative complexity in securing the boat to the upright member, involving bars or supports that overlie the open area of the boat, or requiring a separate wedging block to force the upright against the gunwale of the boat and requiring a specific design for the hull of the boat. Inherent in these designs is their inability to provide for a quick and simple connection and disconnection from the uprights.

Accordingly, it is a principal object of the present invention to provide an improved boat stabilizing device that is easily utilized.

Another object is to provide such a device that is usable with many types of boats and does not require a specific hull structure in order to secure its associated upright members to the boat.

These objects, and others that will become apparent upon reference to the following detailed description and accompanying drawings, are provided by a boat stabilizing system for use with a boat having vertically-oriented tubular sockets adjacent the gunwales thereof. Vertically-oriented upright members in contact with the bottom extend upwardly through the water adjacent the tubular sockets. A clamping member is associated with each upright member and includes a tubular sleeve that slidingly overfits the upright member. Each tubular sleeve includes a screw clamp for securing the tubular sleeve to the upright. An arm secured to the tubular sleeve is sized to overlie the gunwale of the boat and includes a downwardly-extending pin member that is sized to be receivable in the tubular socket.

DETAILED DESCRIPTION OF THE PREFERRED EMBODIMENT

Figure 1:
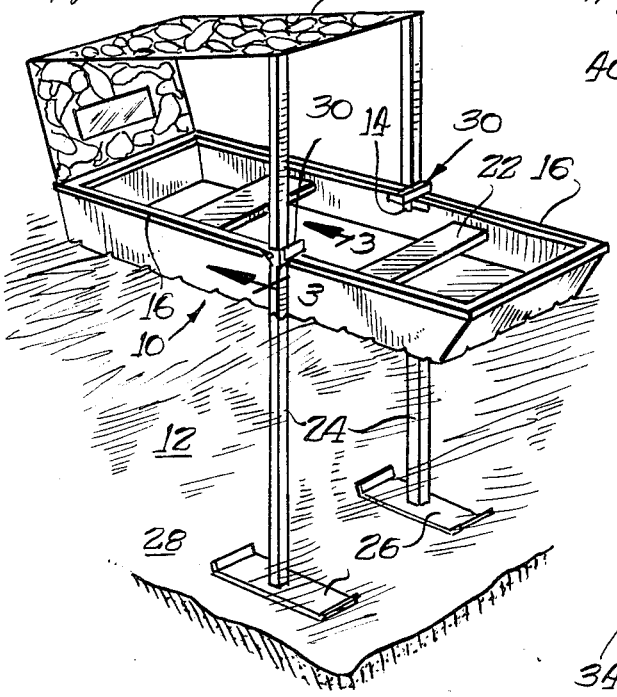
FIG. 1 is a perspective view showing the inventive device being used in conjunction with a row boat and supporting a camouflaged canopy.
Figure 2:
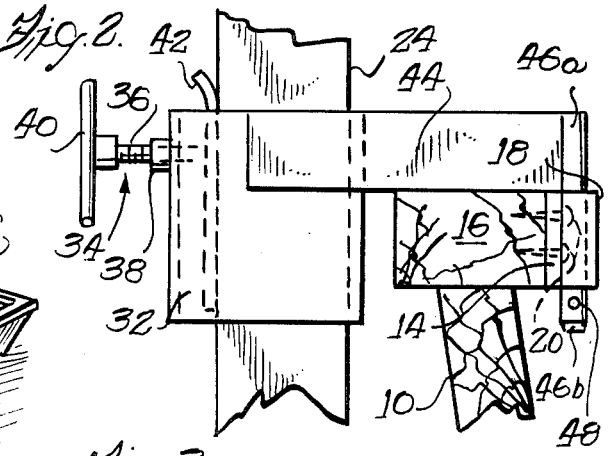
FIG. 2 is a side elevation of the clamping device in place over the gunwale of a boat and its associated upright member.
Figure 3:
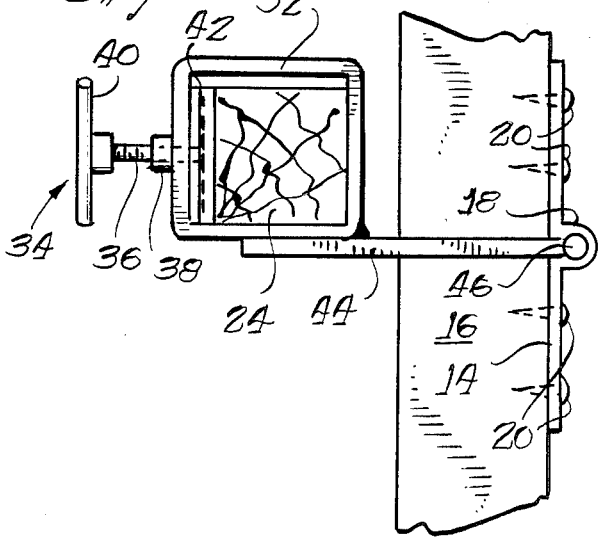
FIG. 3 is a plan view of the clamping device clipped in place over the gunwale of a boat with the upright member shown in cross-section, taken substantially along line 3—3 of FIG. 1.
Figure 4:
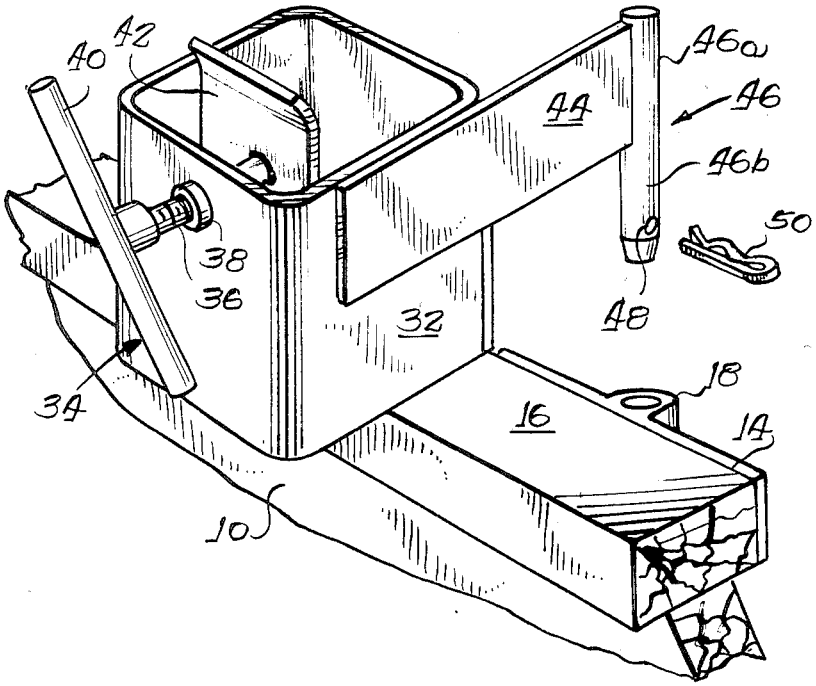
FIG. 4 is an enlarged perspective view of the clamping device.

Turning to the figures of the drawing, which are by way of illustration and not limitation, there is seen in FIG. 1 a rowboat 10 of the type with which the present invention may be advantageously used. The boat 10 is shown floating on the surface of a lake or river 12 in shallow water, e.g., water approximately five to six feet deep or less. As is typical of oar-powered craft, oarlock sockets, such as those indicated by 14, are secured to the interior of the boat 10 on or adjacent to the gunwales 16 for receiving the downwardly-extending pin of an oarlock (not shown) that is used for holding the oar in place during rowing. As best seen in FIGS. 2–4, each oarlock socket 14, which is typically made of metal, includes a vertically-oriented tubular socket 18 and is secured to the gunwale 16 by a plurality of screws 20 astern the rowing thwart 22 (FIG. 1). A pair of uprights or stilts 24 extend vertically upward from enlarged, planar feet 26 that rest upon the lake or river bed or bottom 28, the uprights extending past the gunwales 16 of the boat 10 along the port and starboard sides thereof. The uprights 24 are secured to the boat amidships by means of the inventive clamping device, generally indicated by 30 and best seen in FIGS. 2–4.

The clamping device 30 includes a vertically-oriented tubular metal sleeve member 32 sized to slide over its associated upright 24. As illustrated, both the sleeve 32 and upright 24 have a similar rectangular or square cross-section. (The uprights 24 are preferably standard-dimension lumber, commonly available in an assortment of lengths from most retail building supply dealers.) To secure the sleeve 32 to the upright 24, the sleeve 32 includes an integral screw clamp 34 having its operating screw 36 extending through one of the sides of the sleeve 32. The operating screw 36 is rotatably captured in an internally-threaded nut 38 welded to the exterior of the sleeve 32 and includes an external handle 40 and movable jaw 42 having a swivel head located on the interior of the sleeve 32. Once the sleeve 32 is properly positioned about its associated upright 24, it may be secured thereto simply by rotating the operating screw 34 by use of the handle 40 to engage the upright 24 with the movable jaw 42, forcing the upright 24 into contact with the opposite side of the sleeve member 32.

In keeping with the invention, means are provided for securing the clamping device 30 to the boat 10. Specifically, each clamping device 30 includes integral means for interfitting with the oarlock socket 14 so that the boat itself requires no additional special structure, reinforcement or configuration, and the clamping device requires no additional wedge member, in order to secure the upright 24 to the boat 10.

Turning to FIGS. 2–4, the tubular sleeve 32 of each clamping device 30 includes an integral arm 44 extending perpendicularly therefrom. Each arm 44 is sized in length to extend transversely across the gunwale 16 and has a downwardly-extending pin 46 affixed to the end thereof. In the illustrated clamping device, the arm member 44 is fabricated separately of, e.g., steel bar stock, with the pin 46 being attached thereto prior to welding the arm 44 to the exterior of the tubular sleeve 32. The pin 46 has a first, upper portion 46*a* that is coextensive with the arm 44, and a second, lower portion 46*b* sized in length and diameter to extend through the tubular socket 18 of the oarlock socket 14. The lower end of the pin 46 is tapered to facilitate its insertion into the tubular socket 18 and, in the portion of the pin that extends below the lowermost point of the socket (as best seen in FIG. 2), a hole 48 extends transversely therethrough for receiving a locking or cotter pin 50 (FIG. 4). The cotter pin 50 may be used to ensure that, when the clamping device 30 is secured to the upright 24 and the pin 48 is located in the tubular socket 18, the clamping device 30 does not become unintentionally disassociated from the boat 10 should the boat be caused to move excessively downward with respect to the uprights 24 due to, e.g., high waves.

In use, after the boat 10 is rowed to its desired location in relatively shallow water, the oars are removed from the oarlock sockets 14 and the uprights 24 are placed into the water 12 on opposite sides of the boat adjacent the sockets 14, the enlarged feet 26 of the uprights 14 resting on the bottom 28. The clamping members 30 are then placed onto their respective uprights with the screw clamp 34 retracted a sufficient distance to allow the sleeve 32 to slide along its associated upright until the pin 46 is inserted into the tubular socket 18 of the oarlock socket 14 and the arm 44 rests on the gunwale 16. The screw clamp 34 is then tightened to secure the upright 14 to the clamping member 30. The boat may be disassociated from the uprights 24 by loosening the screw clamp 34 and raising the clamping member 30 so that the pin 46 clears the oarlock socket 14. Thus, if a boat has oarlock sockets and the arm of the clamping device is longer than the width of the gunwale, the inventive oarlock stabilizing system may be advantageously utilized, regardless of the hull configuration.

As an option, the uprights 24 may be sized in length to extend a sufficient distance above the surface of the water 12 to also support a canopy 52 (FIG. 1). Such a canopy may be desirable when the boat 10 is used for, e.g., duck hunting, in which case the canopy 52 could be camouflaged.

From the foregoing, it can be seen that an oarlock stabilizing device has been provided that fully meets the objects set forth above. Although the invention has been described in terms of a preferred embodiment, there is no intent to limit it to the same. On the contrary, it is is intended to cover all equivalents and modifications within the scope of the appended claims.

What is claimed is:

1. Clamping means for inhibiting the rocking of a boat floating on a body of water including an interior bounded on opposed sides by gunwales having top, interior, and exterior sides, the boat having oarlock socket means mounted to each gunwale interior side for receiving a pin connected to an oar for rowing said boat, said clamping means securing the boat to a pair of generally vertical upright members having lower ends in contact with a bottom of a body of water, comprising:

gunwale-engaging arm means having interior and exterior ends and an intermediate gunwale-engaging portion for engaging the top of said gunwale;

a generally vertical tubular sleeve downwardly-depending from said arm means exterior end so as to extend below said gunwale top side adjacent the exterior side of said gunwale, said tubular sleeve having an interior sidewall defining a hollow interior of generally rectangular cross-section, dimensioned to slidingly receive one said upright member having a similar cross-section;

manually-operable screw clamp means comprising a threaded shaft receivable in said tubular sleeve, a handle at one end of said shaft for threadingly advancing said shaft and a plate-like engaging means for releasably pressing said upright member against the interior side wall of said tubular sleeve; and a mounting pin of preselected length downwardly extending from said arm means interior end so as to extend into said boat interior beneath said gunwale top side adjacent the interior side of said gunwale so as to be receivable in said oarlock socket means, said mounting pin having a free end extending below said oarlock socket means, defining an aperture for receiving a locking pin therein to prevent upward withdrawal of said mounting member through said oarlock pin-receiving socket.

2. The clamping means of claim 1 wherein said intermediate gunwale-engaging portion comprises a generally flat plate having generally vertically-oriented major surfaces and a minor surface in contact with said gunwale top surface.

3. The clamping means of claim 2 wherein said flat plate is secured at one end to an exterior surface of said tubular sleeve.

4. The clamping means of claim 1 further comprising upright members of continuous generally rectangular cross-section receivable in said tubular sleeve and having a length such that an upper free end thereof extends vertically above the gunwales of the boat a distance sufficient to support canopy means overlying the boat.

* * * * *